US009272863B2

(12) United States Patent
Shimoyama et al.

(10) Patent No.: US 9,272,863 B2
(45) Date of Patent: Mar. 1, 2016

(54) SHEET FEEDING DEVICE AND IMAGE FORMING APPARATUS

(71) Applicant: KONICA MINOLTA, INC., Chiyoda-ku, Tokyo (JP)

(72) Inventors: Atsuhiko Shimoyama, Tahara (JP); Noboru Oomoto, Toyokawa (JP); Hiroaki Umemoto, Neyagawa (JP); Hiroshi Mizuno, Aisai (JP); Ryo Oshima, Anjo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/216,997

(22) Filed: Mar. 17, 2014

(65) Prior Publication Data

US 2014/0265105 A1 Sep. 18, 2014

(30) Foreign Application Priority Data

Mar. 18, 2013 (JP) ..... 2013-054834

(51) Int. Cl.

| | |
|---|---|
| ***B65H 3/48*** | (2006.01) |
| ***B65H 3/12*** | (2006.01) |
| ***B65H 3/64*** | (2006.01) |
| ***B65H 7/02*** | (2006.01) |
| *B65H 7/14* | (2006.01) |

(52) U.S. Cl.

CPC ..... *B65H 3/48* (2013.01); *B65H 3/128* (2013.01); *B65H 3/64* (2013.01); *B65H 7/02* (2013.01);

(Continued)

(58) Field of Classification Search

CPC .... B65H 3/0692; B65H 3/0816; B65H 3/128; B65H 3/14; B65H 3/48; B65H 3/64; B65H 5/222; B65H 5/224; B65H 5/226; B65H 5/228; B65H 7/02; B65H 2553/412; B65H 2553/414; B65H 2553/44; B65H 2553/82; B65H 2553/42; B65H 2553/46

USPC ..... 271/97, 98, 94, 12

See application file for complete search history.

(56) References Cited

U.S. PATENT DOCUMENTS 4,858,019 A * 8/1989 Ohara et al. ..... 358/474
6,636,704 B2 * 10/2003 Weaver et al. ..... 399/23

(Continued)

FOREIGN PATENT DOCUMENTS

JP 2002060093 A 2/2002
JP 2005104723 A 4/2005

(Continued)

OTHER PUBLICATIONS

Japanese Office Action dated Mar. 3, 2015, issued in counterpart Japanese Application No. 2013-054834.

*Primary Examiner* — Michael McCullough
(74) *Attorney, Agent, or Firm* — Holtz, Holtz & Volek PC

(57) ABSTRACT

A sheet feeding device having; a mounting portion capable of accommodating a stack of sheets; a blowing device that blows air onto the stack placed in the mounting portion, thereby floating at least a top sheet from the stack; a suction/transportation mechanism that includes a suction belt provided above the mounting portion and attracting the top sheet floated by the blowing device to transport the attracted sheet toward a transportation path; an image pickup device disposed so as to capture an image of the floated top sheet and the next sheet therebelow; and an illuminating device that emits light toward an area to be captured by the image pickup device. The light emitted by the illuminating device illuminates a plane in a direction approximately normal thereto, the plane including the closest end surface of the stack of sheets to the image pickup device.

14 Claims, 14 Drawing Sheets

(52) U.S. Cl.
CPC ..... *B65H 7/14* (2013.01); *B65H 2404/264* (2013.01); *B65H 2405/15* (2013.01); *B65H 2405/312* (2013.01); *B65H 2405/332* (2013.01); *B65H 2511/22* (2013.01); *B65H 2515/212* (2013.01); *B65H 2553/414* (2013.01); *B65H 2553/42* (2013.01); *B65H 2553/46* (2013.01); *B65H 2553/82* (2013.01); *B65H 2701/1311* (2013.01); *B65H 2801/06* (2013.01)

(56) References Cited

U.S. PATENT DOCUMENTS

| | | | | |
|---|---|---|---|---|
| 7,663,769 | B2 * | 2/2010 | Hayashihara et al. | 356/630 |
| 8,014,047 | B2 * | 9/2011 | Machida | H04N 1/00681 271/145 |
| 8,210,518 | B2 * | 7/2012 | Suzuki | 271/97 |
| 8,336,870 | B2 * | 12/2012 | Kobayashi | 271/10.01 |
| 8,396,384 | B2 * | 3/2013 | Hayashihara et al. | 399/45 |
| 2010/0295238 | A1 * | 11/2010 | Suzuki | 271/11 |
| 2011/0051997 | A1 | 3/2011 | Nakano et al. | |

FOREIGN PATENT DOCUMENTS

| | | | |
|---|---|---|---|
| JP | 2007240522 | A | 9/2007 |
| JP | 2010-254462 | A | 11/2010 |
| JP | 2011051768 | A | 3/2011 |

* cited by examiner

SHEET FEEDING DEVICE AND IMAGE FORMING APPARATUS

This application is based on Japanese Patent Application No. 2013-054834 filed on Mar. 18, 2013, the content of which is incorporated herein by reference.

BACKGROUND OF THE INVENTION

1. Field of the Invention

The present invention relates to a sheet feeding device that pneumatically floats sheets to be picked up one by one from a sheet stack and fed into a transportation path, and the invention also relates to an image forming apparatus including the sheet feeding device.

2. Description of Related Art

A conventional sheet feeding device is described in, for example, Japanese Patent Laid-Open Publication No. 2010-254462. In the sheet feeding device described in Japanese Patent Laid-Open Publication No. 2010-254462, a stack of sheets (e.g., paper) is placed in a mounting portion of a feed tray or suchlike. The sheet feeding device blows air onto the stack of sheets from opposite sides, thereby separating and floating the top sheet. Simultaneously, air above the stack of sheets is sucked through a suction belt, so that the floated top sheet is attracted to the suction belt. The suction belt transports the attracted sheet to the transportation path, thereby feeding the sheet into the transportation path.

To adjust the amount of air to be blown onto the stack of sheets, the sheet feeding device uses an image pickup device to capture an image of the floated top sheet and the next sheet therebelow. Thereafter, edges of the sheets are detected from the captured image, and the gap between the sheets is calculated. Subsequently, the sheet feeding device adjusts the amount of air on the basis of the calculated gap.

However, the amount of light inside the sheet feeding device is insufficient for an image to be captured inside the sheet feeding device. Therefore, in some cases, edge detection might not be performed accurately. Moreover, during edge detection, at least the top sheet is floated, often with the result that its edges flap up and down. Consequently, depending on the degree of illumination, edge detection might not be performed accurately. As such, conventional sheet feeding devices have difficulty in calculating the exact gap between sheets.

SUMMARY OF THE INVENTION

A sheet feeding device according to a first aspect of the present invention includes a mounting portion capable of accommodating a stack of sheets, a blowing device configured to blow air onto the stack of sheets placed in the mounting portion, thereby floating at least a top sheet from the stack, a suction/transportation mechanism including a suction belt provided above the mounting portion and configured to attract the top sheet floated by the blowing device to transport the attracted sheet toward a transportation path, an image pickup device disposed so as to be capable of capturing an image of the floated top sheet and the next sheet therebelow, and an illuminating device configured to emit light toward an area to be captured by the image pickup device. The light emitted by the illuminating device illuminates a plane in a direction approximately normal thereto, the plane including the closest end surface of the stack of sheets to the image pickup device.

An image forming apparatus according to a second aspect of the present invention includes a sheet feeding device of the first aspect.

DETAILED DESCRIPTION OF THE PREFERRED EMBODIMENTS

Figure 1:
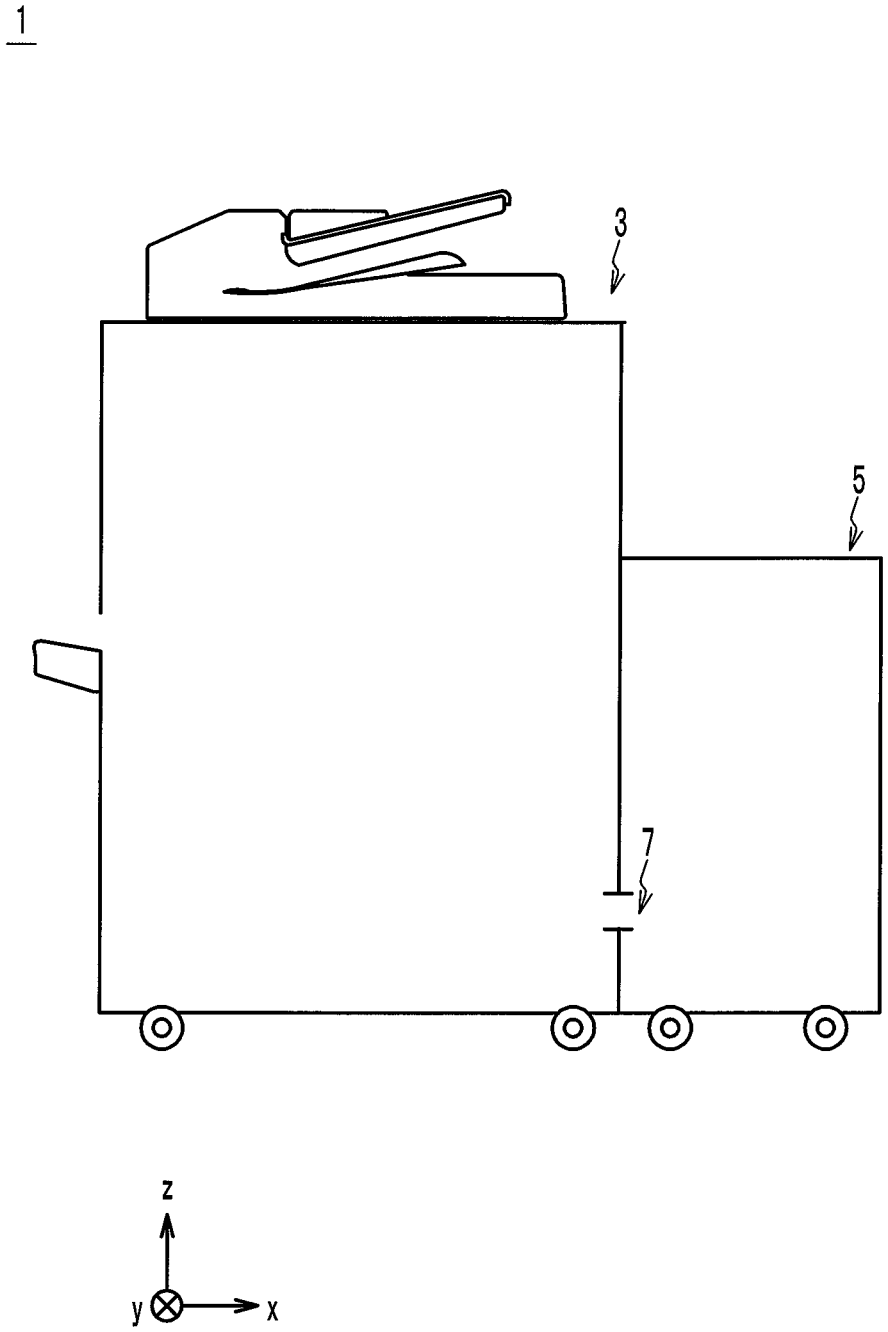
FIG. 1 is a diagram illustrating the configuration of an image forming apparatus including a sheet feeding device according to an embodiment.

Hereinafter, a sheet feeding device according to an embodiment of the present invention and an image forming apparatus including the same will be described in detail with reference to the drawings.

First, the x-, y-, and z-axes in the drawings will be defined. In the present embodiment, it is assumed that the x-, y-, and z-axes correspond to the right-left, front-back, and top-bottom directions, respectively, of each of the sheet feeding device and the image forming apparatus. Some components in the drawings have the suffix a, b, c, or d added to the right of their reference numerals. The suffixes a, b, c, and d refer to yellow (Y), magenta (M), cyan (C), and black (Bk), respectively. For example, an imaging portion 27*a* means an imaging portion 27 for yellow. In addition, reference numerals without suffixes mean any of the colors Y, M, C, and Bk. For example, an imaging portion 27 means an imaging portion for any one of the colors Y, M, C, and Bk.

Configuration and Operation of Image Forming Apparatus

In FIG. 1, the image forming apparatus 1 includes a main unit 3 and a sheet feeding unit 5.

Figure 2:
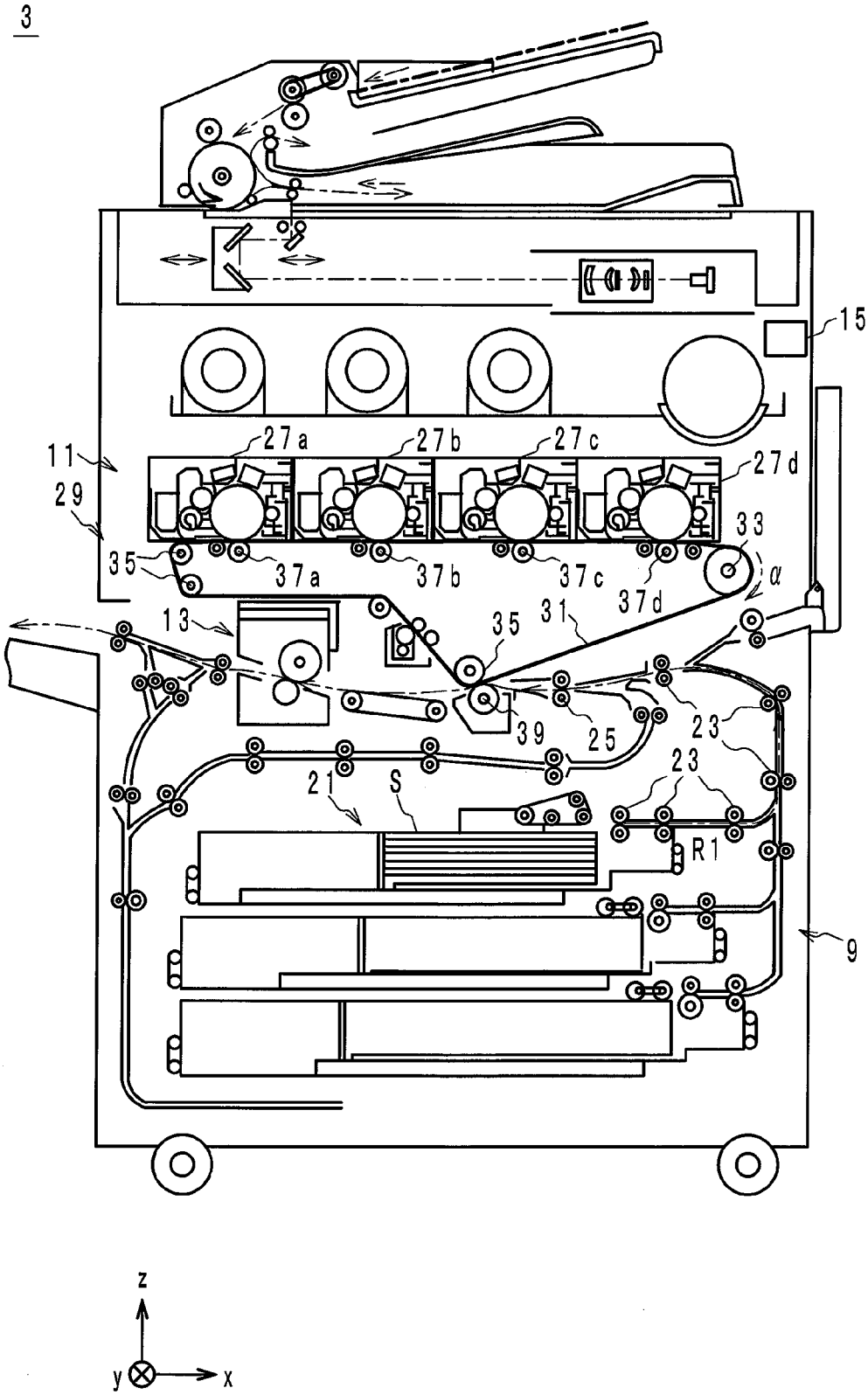
FIG. 2 is a diagram illustrating in detail the configuration of a main unit in FIG. 1.

The main unit 3 is, for example, a multifunction peripheral (MFP), and includes a sheet feeding unit 9, an imaging unit 11, a fusing unit 13, and a control circuit 15, as shown in FIG. 2.

The sheet feeding unit 9 generally includes a sheet feeding device 21, a plurality of feed roller pairs 23, and a registration roller pair 25. The sheet feeding device 21 accommodates a plurality of sheets (e.g., paper) placed therein as a stack of sheets S. The sheet feeding device 21 pneumatically floats the top sheet to be picked up from the stack of sheets S, and feeds the sheet into a first transportation path R1 indicated by a long dashed short dashed line. The fed sheet is transported downstream through the first transportation path R1 by the feed roller pair 23 being rotated. Thereafter, the sheet contacts the registration roller pair 25 at rest, and stops there temporarily. The registration roller pair 25 is rotated under timing control by a CPU to be described later, so that the sheet is fed from the registration roller pair 25 to a secondary transfer region.

The imaging unit 11 forms an image by means of electrophotography. In addition, in the present embodiment, the imaging unit 11 has a tandem configuration to form a full-color image, and includes imaging portions 27*a* to 27*d* and a transfer portion 29.

Each of the imaging portions has a rotatable photoreceptor drum for its corresponding color. There are a charging unit, an exposing unit, and a developing unit provided around the photoreceptor drum.

The charging unit uniformly charges the circumferential surface of the photoreceptor drum for the corresponding color.

The exposing unit receives image data for the corresponding color. Here, the image data is transmitted to the CPU from a personal computer or suchlike connected to the main unit 3. The CPU generates image data for each of the colors Y, M. C, and Bk, on the basis of received image data, and outputs the generated data to the exposing unit corresponding to the color. The exposing unit generates an optical beam modulated with the image data for the corresponding color, and scans line by line the circumferential surface of the photoreceptor drum being rotated, thereby forming an electrostatic latent image in the corresponding color on the circumferential surface.

The developing unit develops the electrostatic latent image formed on the photoreceptor drum for the corresponding color, by toner, thereby forming a toner image in the color on the circumference surface of the photoreceptor drum.

The transfer portion 29 generally includes an intermediate transfer belt 31 in an endless form, a drive roller 33, a plurality of driven rollers 35, primary transfer rollers 37*a* to 37*d*, and a secondary transfer roller 39.

The intermediate transfer belt 31 is stretched around the drive roller 33 and the driven rollers 35. The drive roller 33 is rotated under control of the CPU, and the driven rollers 35 are rotated following the rotation of the drive roller 33. As a result, the intermediate transfer belt 31 rotates in the direction indicated by arrow $\alpha$.

The primary transfer rollers 37 are disposed so as to be opposite to the photoreceptor drums for their corresponding colors, with the intermediate transfer belt 31 positioned therebetween. By virtue of the primary transfer rollers 37, toner images supported on the photoreceptor drums are transferred sequentially onto the same area of the intermediate transfer belt 31, so as to overlap with one another, resulting in a composite toner image. The composite toner image is carried toward the secondary transfer roller 39 through rotation of the intermediate transfer belt 31.

The secondary transfer roller 39 is disposed so as to be opposite to one of the driven rollers 35 with the intermediate transfer belt 31 positioned therebetween. In addition, the secondary transfer roller 39 is in contact with the intermediate transfer belt 31, forming a secondary transfer region therebetween. A sheet fed from the registration roller pair 25 is introduced into the secondary transfer region. The sheet passing through the secondary transfer region is subjected to secondary transfer of the composite toner image from the intermediate transfer belt 31. Thereafter, the sheet subjected to the secondary transfer is fed from the secondary transfer region toward the fusing unit 13.

The fusing unit 13 has a fusing nip formed by a heating roller and a pressure roller. The sheet from the secondary transfer region is introduced to the fusing nip. The sheet is heated and pressed while it is passed through the fusing nip by rotation of the rollers. As a result, the composite toner image is fixed on the sheet. Thereafter, the sheet subjected to the fusing processing is fed from the fusing nip toward an output tray outside the main unit.

The control circuit 15 includes at least flash memory, the CPU, and main memory. The CPU executes a program, which is stored in, for example, the flash memory, in the main memory to control various components (including the sheet feeding unit 5, etc.).

Figure 3:
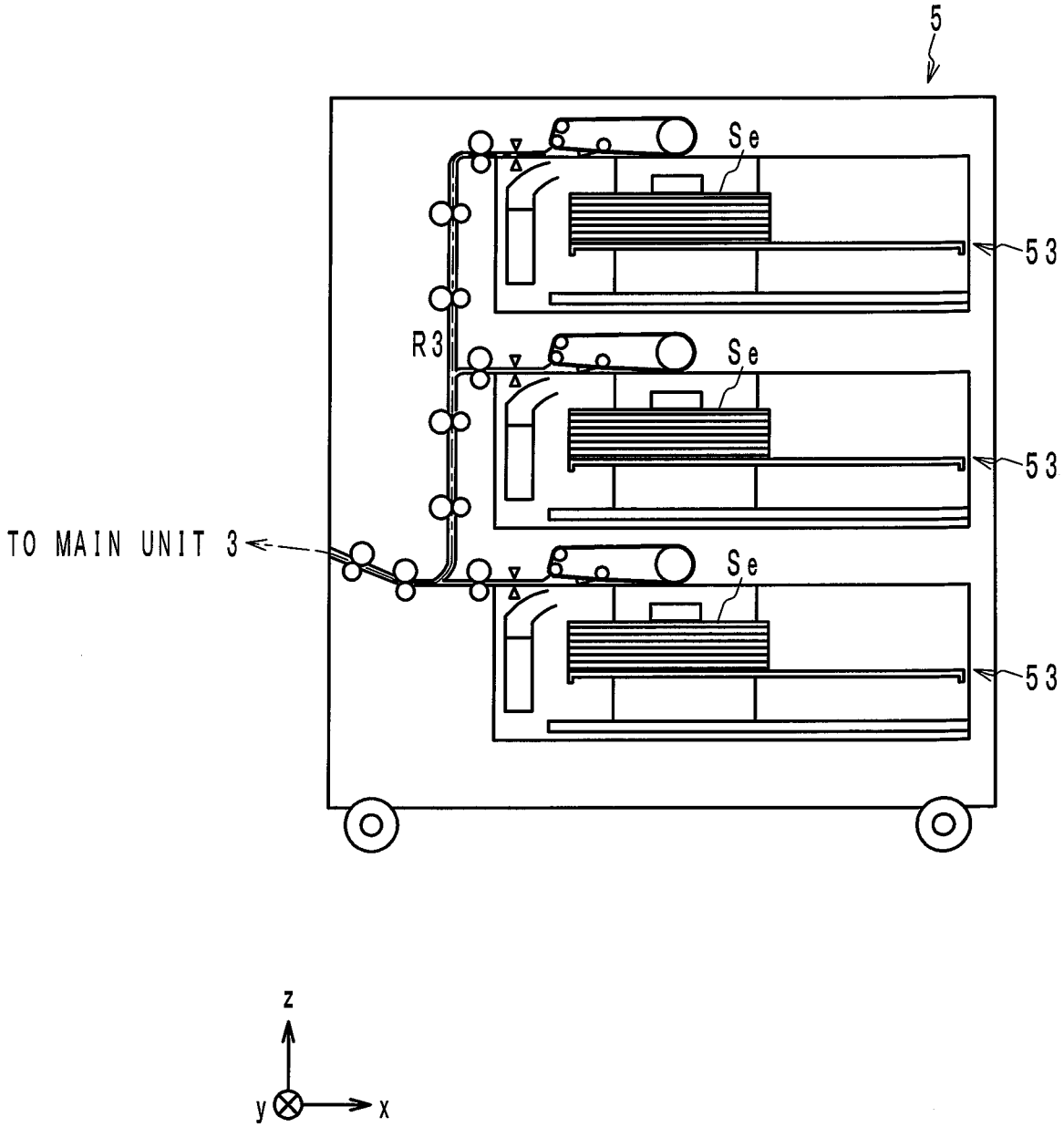
FIG. 3 is a diagram illustrating in detail the configuration of feeding units in FIG. 1.

In the image forming apparatus 1, the sheet feeding unit 5 is disposed adjacently to the right of the main unit 3, as shown in FIG. 1. The sheet feeding unit 5 includes a plurality of vertically arranged sheet feeding devices 53, as shown in FIG. 3.

Each of the sheet feeding devices 53 has the same configuration as the sheet feeding device 21 (to be described in detail later), and accommodates a plurality of sheets (e.g., paper) placed therein as a stack of sheets Se. The sheet feeding device 53 (to be described in detail later) pneumatically floats the top sheet to be picked up from the stack of sheets Se, and feeds the sheet into a third transportation path R3 (indicated by a long dashed short dashed line). The fed sheet is transported through the third transportation path R3, and thereafter, fed through a communicating slit 7 (see FIG. 1) into the main unit 3. The main unit 3 is provided with a transportation path (not shown) through which the sheet fed from the sheet feeding device 53 is transported to the registration roller pair 25. Accordingly, an image is formed on the sheet as well in the same manner as described above.

Configuration and Operation of Sheet Feeding Device

Next, the configuration of the sheet feeding device 53 will be described with reference to FIGS. 4 and 5. Note that the sheet feeding device 21 has the same configuration as the sheet feeding device 53, as mentioned earlier, and therefore, any description thereof will be omitted.

The sheet feeding device 53 includes an elevating plate 55, an abutting portion 57, a limit sensor 59, a suction/transportation mechanism 61, a transportation roller pair 63, a feed sensor 65, first blowing mechanisms 67, a second blowing mechanism 69, and a suction sensor 70.

The elevating plate 55 has a rectangular mounting portion 71 approximately parallel to the xy plane. The mounting portion 71 accommodates a plurality of sheets piled in the z-axis direction therein as a stack of sheets Se. The stack of sheets Se forms a substantially rectangular solid. The elevating plate 55 is configured so as to be movable up and down (i.e., elevatable) along the z-axis direction between predetermined lower and upper limit positions.

The abutting portion 57 has an abutting face 73. The abutting face 73 extends upward in a direction parallel to the z-axis, from a side of the mounting portion 71 that is located on the negative side of the x-axis. The abutting face 73 contacts a side of the stack of sheets Se that is located on the negative side of the x-axis (i.e., the left side of the stack). Note that each sheet is fed into the third transportation path R3 from the short side located on the negative side of the x-axis. From this viewpoint, the left side of the stack of sheets Se will also be referred to below as the front side of the stack of sheets Se, and the left side of the sheet will also be referred to below as the front side of the sheet.

The limit sensor 59 is typically an active optical sensor fixed to the abutting portion 57. The limit sensor 59 outputs an electrical signal to the control circuit 15 (to be described later) in order to specify whether or not the top sheet of the stack of sheets Se has reached a predetermined upper limit position Pu.

The suction/transportation mechanism 61 is provided above the elevating plate 55 and the abutting portion 57, and specifically includes, for example, two suction belts 74, a chamber 79, a drive roller 75, and for example, three driven rollers 77.

Each of the suction belts 74 is an endless belt. Each belt 74 has a number of holes piercing from the outer surface to the inner surface. More specifically, a predetermined number of through-holes (namely, arrays of through-holes) are provided along the width direction of each belt 74 (i.e., the direction parallel to the y-axis). The arrays of through-holes are bored at predetermined intervals across the entire length of the belt.

The chamber 79 is provided inside relative to the suction belts 74, and generally includes an air inlet, a fan, and a motor. The air inlet is provided so as to face the inner surfaces of the suction belts 74 that extend therebelow. The fan is housed in the chamber. By rotating the fan, air above the stack of sheets Se is taken into the chamber 79 from the through-holes in the suction belts 74. At this time, the top sheet is floated by the first blowing mechanisms 67, etc., as will be described later, and therefore attracted to the bottom surfaces of the suction belts 74. From this viewpoint, the bottom surfaces of the suction belts 74 will also be referred to below as suction surfaces.

For example, the drive roller 75 is positioned above the center of the stack of sheets Se in the x-axis direction. Moreover, two of the three driven rollers 77 are arranged side by side approximately in the vertical direction above the second blowing mechanism 69. These rollers 77 are positioned offset from each other in the x-axis direction on the negative side relative to the abutting face 73. In addition, the remaining driven roller 77 (also referred to below as the intermediate driven roller) is positioned between the lower driven roller 77 (also referred to below as the left driven roller) and the drive roller 75.

The two suction belts 74 are stretched around the rollers 75 and 77, so as to be positioned side by side in the y-axis direction. More specifically, the drive roller 75 and the intermediate driven roller 77 are arranged with their bottoms approximately at the same position in the z-axis direction. Moreover, the intermediate driven roller 77 and the left driven roller 77 are arranged such that the bottom position of the intermediate driven roller 77 is slightly higher than the bottom position of the intermediate driven roller 77. As a result, each of the suction belts 74 is positioned approximately parallel to the xy plane between the drive roller 75 and the intermediate driven roller 77, and inclined diagonally upward relative to the xy plane between the intermediate driven roller 77 and the left driven roller 77. In other words, each suction belt 74 is curved at the intermediate driven roller 77. The suction belts 74 as above rotate in the direction indicated by arrow β in accordance with the rotation of the drive roller 75. Thus, the top sheet attracted to the suction surfaces of the suction belts 74 is transported in the direction toward the negative end of the x-axis (i.e., in the transportation direction).

Figure 4:
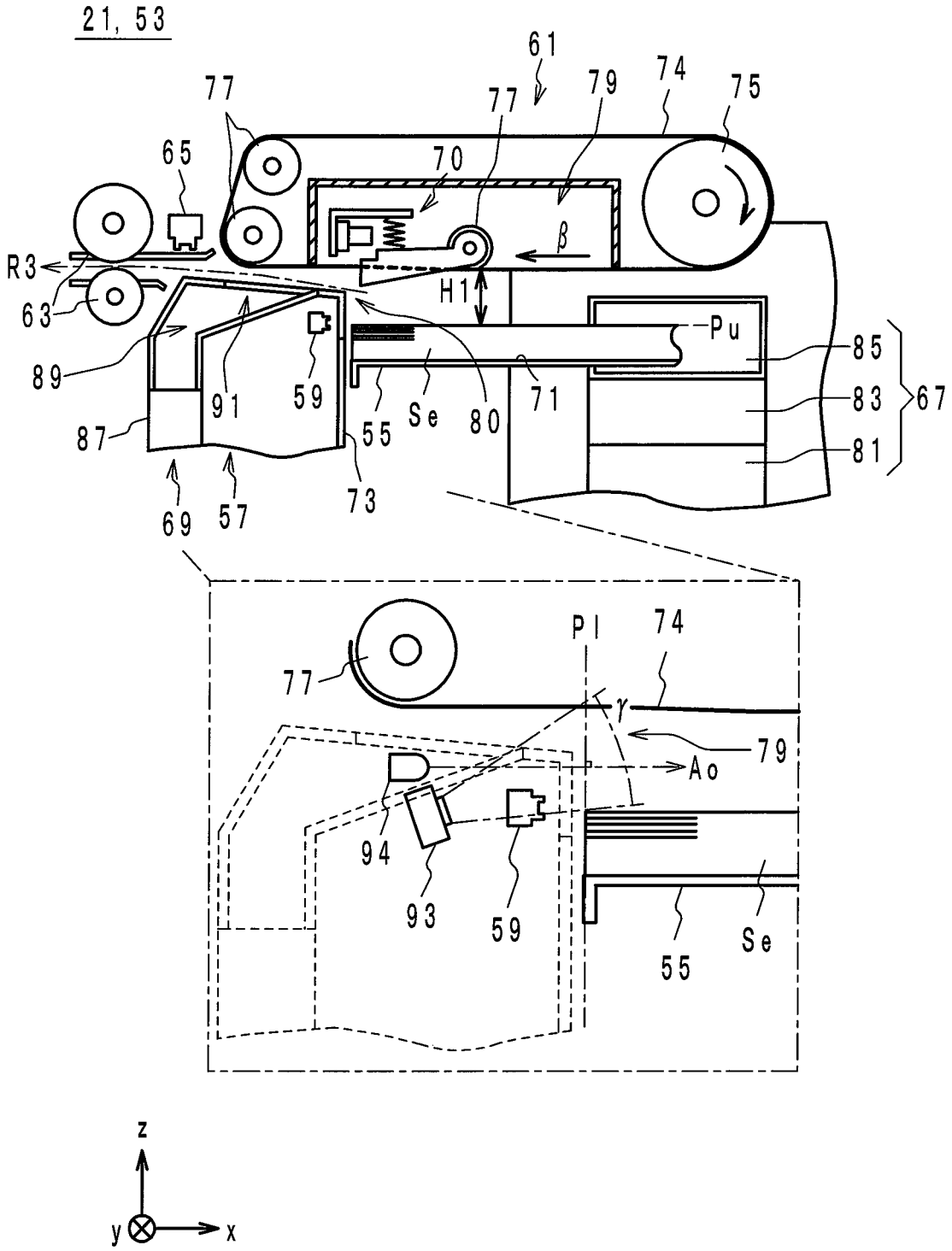
FIG. 4 is a cross-sectional view of the sheet feeding device taken along the ZX plane of FIG. 3 as viewed from the front side.
Figure 5:
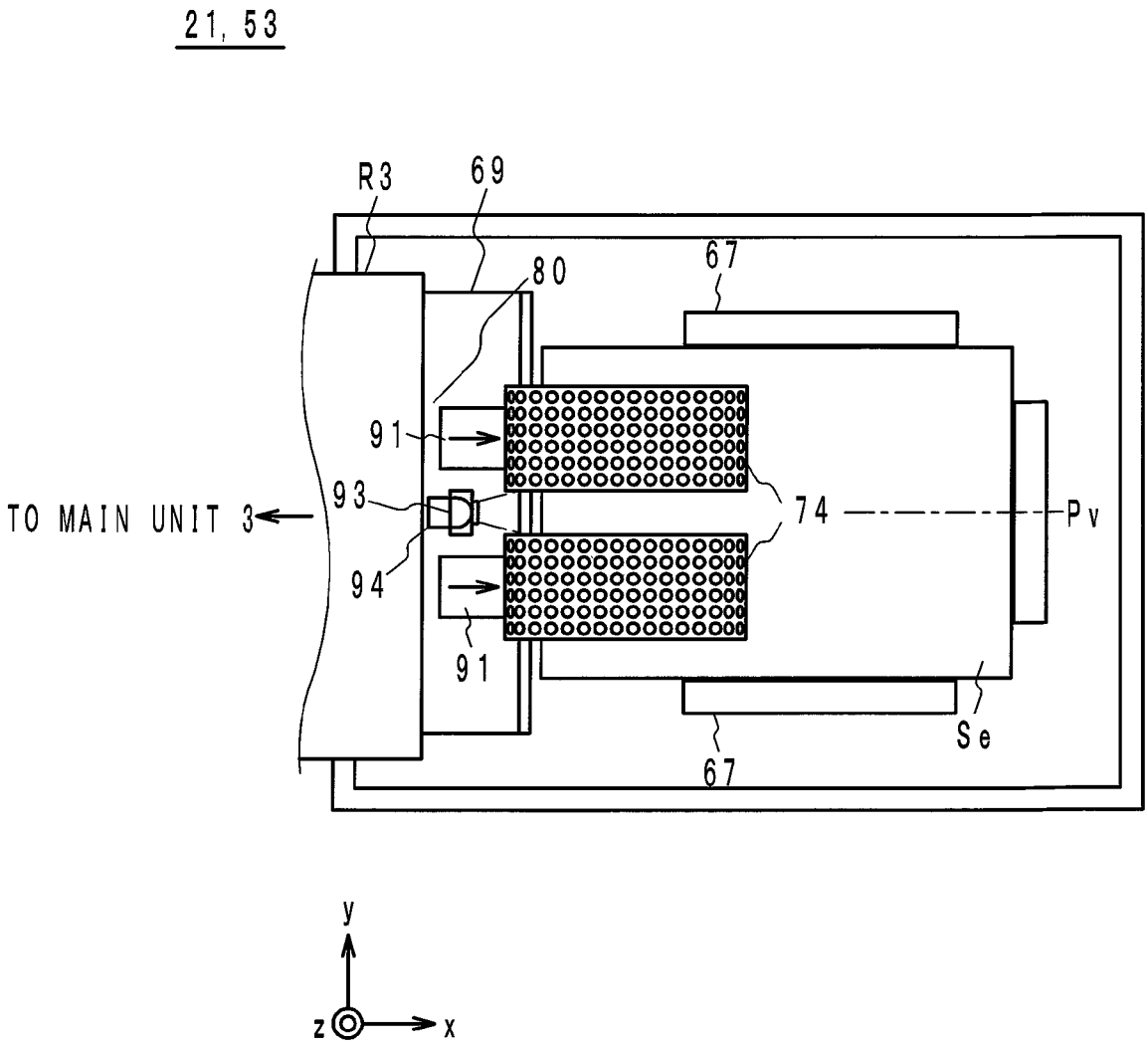
FIG. 5 is a cross-sectional view of the sheet feeding device taken along the XY plane of FIG. 3 as viewed from the top side.

FIGS. 4 and 5 show the beginning of the third transportation path R3. The third transportation path R3 generally consists of a plurality of guiding members. The beginning of the third transportation path R3 is a sheet entrance 80. The entrance 80 is the space between the top edge of the abutting portion 57 and the bottom of the left driven roller 77.

The transportation roller pair 63 is provided near the entrance 80 in the third transportation path R3. The transportation roller pair 63 is rotated under control of the CPU to receive a sheet introduced therebetween and feed it downstream in the third transportation path R3.

Here, the feed sensor 65 is typically an active optical sensor provided between the entrance 80 and the transportation roller pair 63 in the third transportation path R3. When a sheet has passed a reference position between the entrance 80 and the transportation roller pair 63, the feed sensor 65 outputs an electrical signal to the control circuit 15 in order to specify such.

The first blowing mechanisms 67 are provided one each on the front and back sides of the image forming apparatus 1 relative to the elevating plate 55. Each of the first blowing mechanisms 67 typically includes a fan 81, a duct 83, and an air outlet 85.

The fan 81 takes ambient air into the duct 83. In the first blowing mechanism 67 on the front side, the duct 83 has the air outlet 85 provided near the top of the stack of sheets Se so as to face the foremost side of the stack. In the first blowing mechanism 67 on the front side, air taken into the duct 83 flows through the duct 83 toward the air outlet 85, and is blown out from the air outlet 85 onto the stack of sheets Se at the upper portion of its front side.

On the other hand, the first blowing mechanism 67 on the back side is substantially symmetrical to the one on the front side relative to the center plane Pv (see FIG. 5) of the mounting portion 71 in the y-axis direction. Accordingly, from the air outlet 85 on the back side, air is blown out onto the stack of sheets Se at the upper portion of its back side.

As described above, the air blown out from both of the air outlets is directed onto the front and back sides of the stack of sheets Se. The air mainly plays the role of floating the top sheet of the stack of sheets Se.

Furthermore, the second blowing mechanism 69 is typically provided on the negative side of the x-axis relative to the mounting portion 71. More specifically, the second blowing mechanism 69 is adjacent to the abutting portion 57 on the negative side of the x-axis. The second blowing mechanism 69 typically includes a fan 87, a duct 89, and, for example, two air outlets 91.

The fan 87 takes its surrounding air into the duct 89. The duct 89 is provided so as to reach the proximity of the entrance 80 of the third transportation path R3. The duct 89 branches two ways at some point such that one air outlet 91 is provided at the end of each branch. In the present embodiment, the two air outlets 91 are spaced apart from each other in the y-axis direction, as shown in FIG. 5. More specifically, the air outlets 91, which are located on the front and back sides, respectively, are provided so as to face the space below the suction belts 74 on the front and back sides, respectively. The air taken into the duct 89 flows toward the two air outlets 91, and is blown out from each of the air outlets 91 toward the positive side of the x-axis. As a result, the air from the air outlets 91 is blown toward a position directly below the corresponding suction belts 74. The air mainly plays the role of separating the top sheet from the next sheet therebelow.

The suction sensor 70 includes at least an active optical sensor and a sensing element, and, when the top sheet of the stack of sheets Se is being attracted to the suction belts 74, the suction sensor 70 outputs an electrical signal to the control circuit 15 in order to specify such.

The sheet feeding device 53 further includes an image pickup device 93. As shown in FIG. 5, the image pickup device 93 is positioned so as not to block flows of air blown out from the two air outlets 91 (see arrows). In the present embodiment, the image pickup device 93, when viewed in a plan view in the z-axis direction, is provided between the two air outlets 91.

More specifically, the image pickup device 93 faces space γ (see the part enclosed by long dashed short dashed lines in FIG. 4) between the suction belts 74 and the foremost edge of the top sheet, such that space γ can be seen through. Here, the wording "seen through" is intended to mean that there is nothing between the lens of the image pickup device 93 and space γ that blocks the field of view of the image pickup device 93. In addition, the term "to face" encompasses the case where the lens of the image pickup device 93 is straight in front of space γ in the x-axis direction, and also encompasses the case where the image pickup device 93 faces space γ from a position diagonally therebelow with respect to the xy plane.

Typically, the image pickup device 93 captures an image of the foremost edges of the floated top sheet and the next sheet therebelow, and outputs data for the image to the control circuit 15 (to be described later).

To capture an image of the foremost edges of the floated top sheet and the next sheet therebelow, the image pickup device 93 is preferably capable of capturing an image of the suction surfaces of the suction belts 74 when the top sheet is not being attracted to the suction belts 74. In addition, the optical axis of the image pickup device 93 is preferably close to at least the air outlets 91 of the second blowing mechanism 69 and the suction surfaces of the suction belts 74 at their positions in the z-axis direction (i.e., in the stacking direction).

The sheet feeding device 53 further includes an illuminating device 94 configured by, for example, a light-emitting diode (LED). When the image pickup device 93 captures an image of the top sheet or the next sheet therebelow, the illuminating device 94 emits light toward an area to be captured by the image pickup device 93. Here, for convenience of the following description, plane P1 is defined below. When the stack of sheets Se is considered as a substantially rectangular solid, the stack of sheets Se has six faces. Among these faces, plane P1 includes the closest face to the image pickup device 93 (in the example in FIG. 4, the left face), and further, plane P1 is parallel to the yz plane. The illuminating device 94 is arranged such that light emitted therefrom is approximately perpendicular to plane P1. Moreover, in the z-axis direction, the position of the optical axis Ao of the illuminating device 94 is preferably close to the position of the optical axis of the image pickup device 93.

Figure 6A:
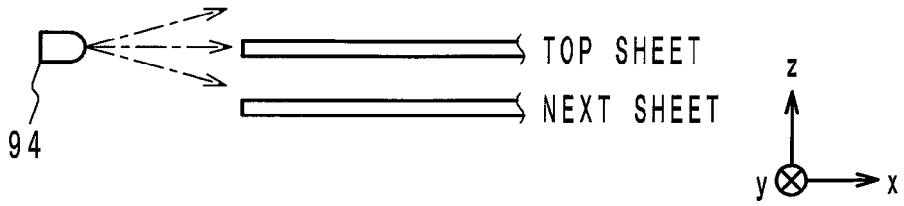
FIG. 6A illustrates light illuminating sheet edges that are not flapping.
Figure 6B:
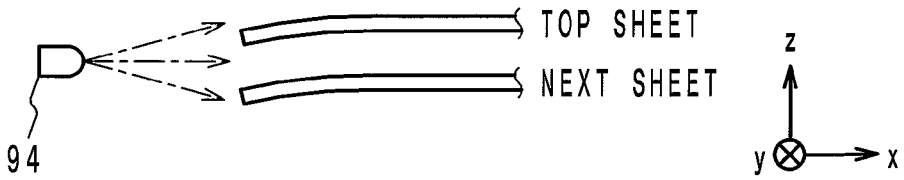
FIG. 6B illustrates light illuminating sheet edges that are flapping to some extent.
Figure 6C:
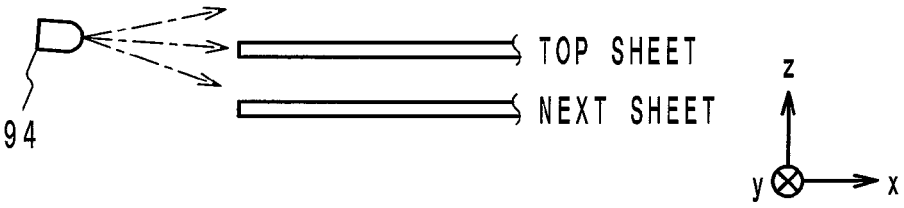
FIG. 6C illustrates light illuminating sheet edges where an illuminating device is attached at an angle beyond the margin of error.
Figure 6D:
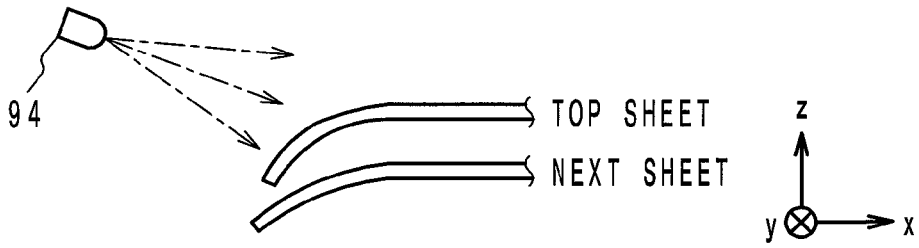
FIG. 6D illustrates light illuminating sheet edges where an illuminating device is tilted.

Even in the case where the top sheet and the next sheet do not flap (see FIG. 6A) or in the case where at least one of the top sheet and next sheet flaps to some extent (see FIG. 6B), the above arrangement allows the emitted light to illuminate the foremost edges of the top sheet and the next sheet in a direction substantially normal thereto, so that the intensity of light reflected by the foremost edges is higher than the intensity of light reflected by other portions. Moreover, even if the illuminating device 94 is attached with the optical axis Ao slightly tilted (i.e., even if the illuminating device 94 is tilted within the margin of error), as shown in FIG. 6C, the emitted light illuminates the foremost edges of the sheets in a direction approximately normal thereto, so that the intensity of light reflected by the foremost edges is relatively high. On the other hand, in the case where the illuminating device 94 is tilted beyond the margin of error and emits light diagonally downward (see FIG. 6D), even when the sheets barely flap, the intensity of light reflected by portions other than the foremost edges might become higher in contrast to the cases shown in FIGS. 6A to 6C.

Note that as with the image pickup device 93, the illuminating device 94 is preferably positioned so as not to block flows of air blown out from the two air outlets 91.

Figure 7:
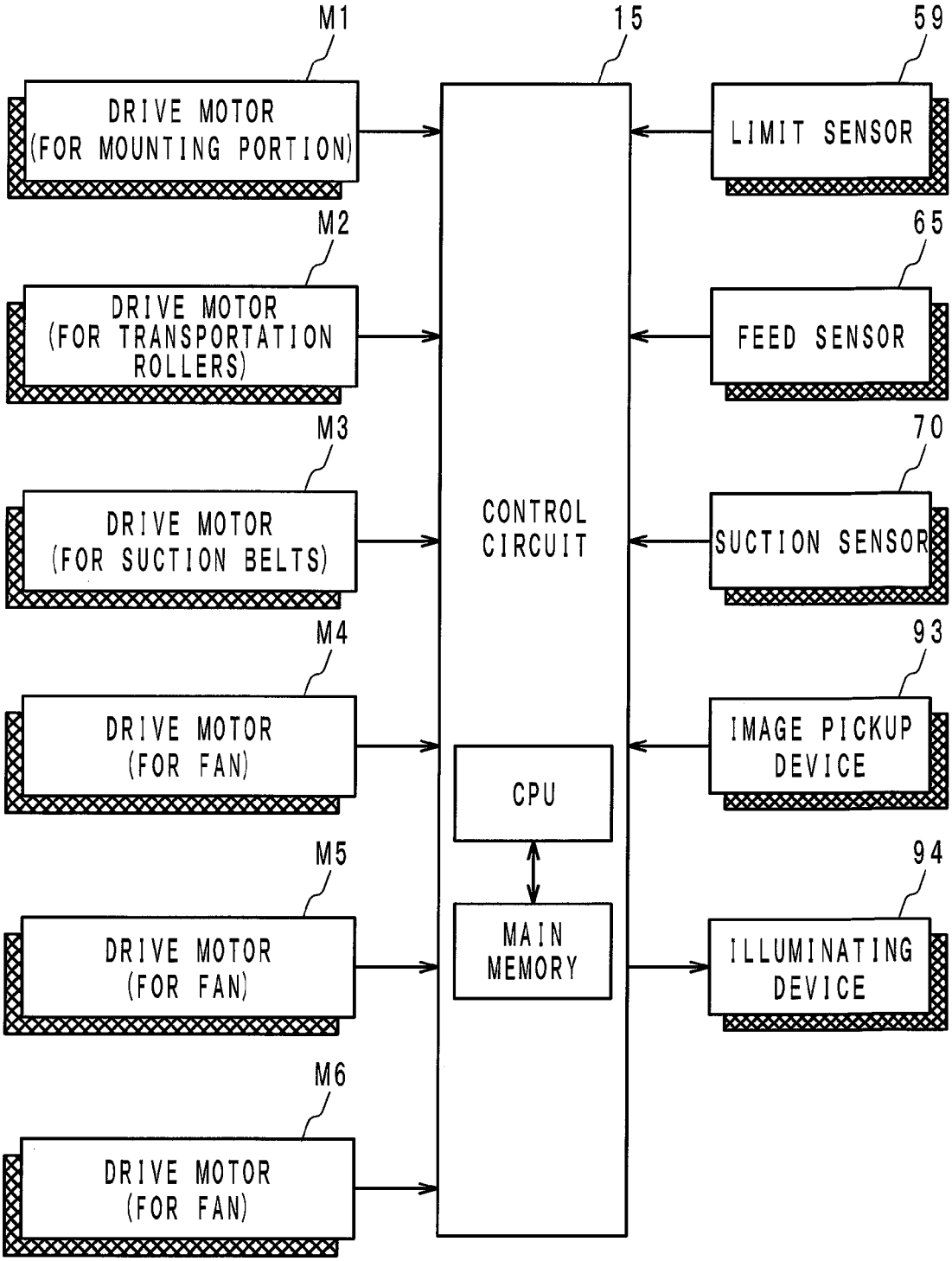
FIG. 7 is a block diagram illustrating a control system of the sheet feeding device in FIG. 3.

Next, referring to FIG. 7, the control system of the sheet feeding device 53 will be described in detail. The sheet feeding device 53, under control of the CPU, pneumatically floats the top sheet to be picked up from the stack of sheets Se, and feeds the sheet into the third transportation path R3. To perform such control, the control circuit 15 is configured so as to be able to receive electrical signals from the limit sensor 59, the feed sensor 65, and the suction sensor 70. Moreover, the control circuit 15 controls the illuminating device 94 so as to illuminate an area to be captured by the image pickup device 93 while the sheet feeding device 53 is in operation. Under this circumstance, the image pickup device 93 captures an image of the foremost edges of the top sheet and the next sheet, and transmits data for the captured image to the control circuit 15.

Furthermore, the control circuit 15 is configured so as to be able to transmit control signals to a drive motor M1 for the mounting portion 71, a drive motor M2 for the transportation roller pair 63, a drive motor M3 for the suction belts 74, a drive motor M4 for the fan 81, a drive motor M5 for the fan 87, and a drive motor M6 for the fan in the chamber 79.

The control circuit 15 has some information prestored in its flash memory or suchlike, regarding the size and grammage of sheet (i.e., the type of sheet), and the initial value for the amount of air suitable for the type of sheet. To achieve the initial value, the control circuit 15 adjusts the amount of air blown out from each of the first blowing mechanisms 67 and/or the amount of air blown out from the second blowing mechanism 69 by controlling the rotation of the drive motors M4 and M5. The control circuit 15 also controls the rotation of the drive motor M6 in the chamber 79.

When the top sheet is being attracted to the suction belts 74, the suction sensor 70 outputs an electrical signal to the control circuit 15 in order to specify such. The control circuit 15 controls the rotation of the drive motor M3 in accordance with the electrical signal.

When a sheet fed into the third transportation path R3 has passed the reference position (as described earlier), the feed sensor 65 outputs an electrical signal to the control circuit 15 in order to specify such. The control circuit 15 controls the rotation of the drive motor M2 in accordance with the electrical signal.

The limit sensor 59 outputs an electrical signal to the control circuit 15 to indicate whether or not the top sheet of the stack of sheets Se is positioned high enough to be attracted to the suction belts 74. The control circuit 15 keeps the top position of the top sheet at a predetermined height by controlling the rotation of the drive motor M1 in accordance with the electrical signal.

Figure 8:
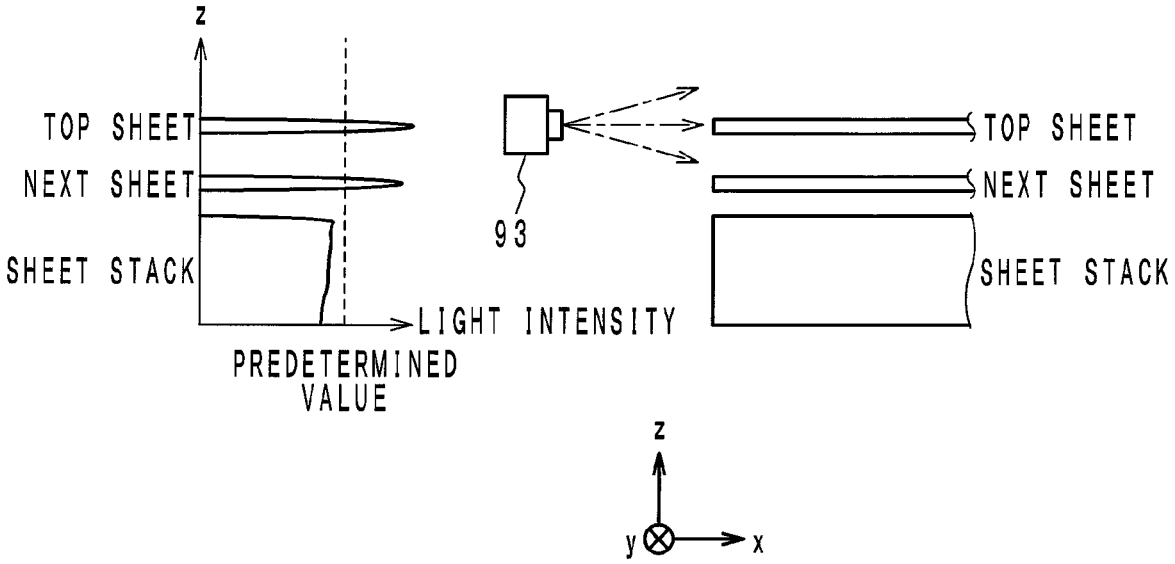
FIG. 8 is a diagram illustrating the intensity of light reflected by the top sheet and the next sheet in an intensity image.

The image pickup device 93 captures an image of the space between the floated top sheet and the next sheet therebelow, and generates data for the captured image, which is outputted to the control circuit 15. Upon reception of the image data, the control circuit 15 performs a feature detection process on the received data. In the feature detection process, the captured image is initially transformed into an intensity image from which pixel portions with intensity values higher than a predetermined value are detected as edges. Here, light emitted from the illuminating device 94 is approximately perpendicular to plane P1 (see FIGS. 6A to 6C), as mentioned earlier, and therefore, the intensity of light reflected by the foremost edges of the top sheet and the next sheet is greater than the predetermined value, as shown in FIG. 8. Accordingly, the foremost edges of the top sheet and the next sheet are detected as the exact edges. Thereafter, the distance between the edges is calculated as the gap between the sheets.

In contrast to the above, if the illuminating device 94 emits light diagonally (see FIG. 6D), the intensity of light reflected by portions other than the foremost edges becomes higher. In such a case, the foremost edges of the top sheet and the next sheet might not be detected as edges by the feature detection process, so that the gap between the sheets cannot be calculated with accuracy.

Figure 9A:
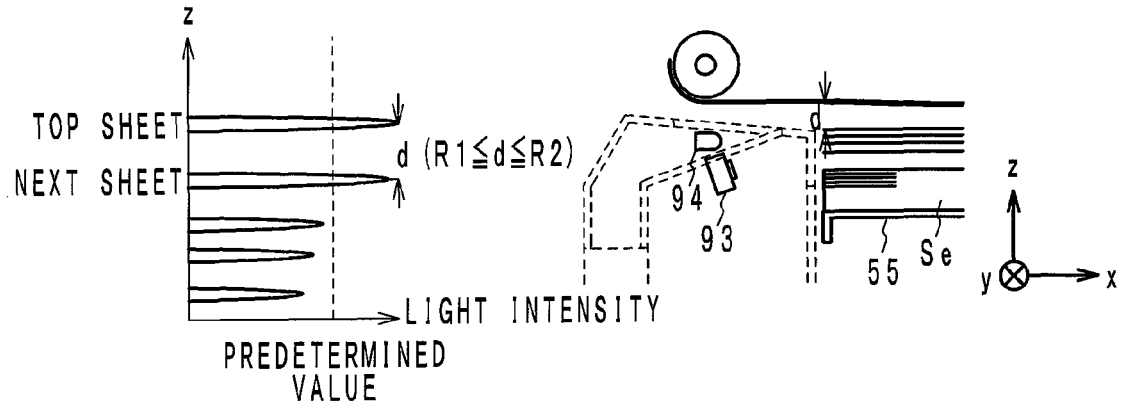
FIG. 9A is a diagram illustrating a calculated gap within an appropriate range.
Figure 9B:
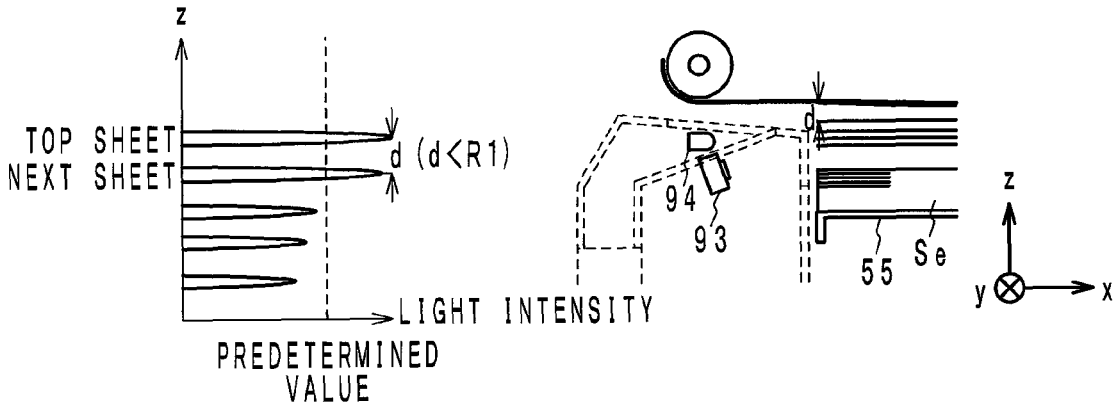
FIG. 9B is a diagram illustrating a calculated gap below a lower limit of the appropriate range.
Figure 9C:
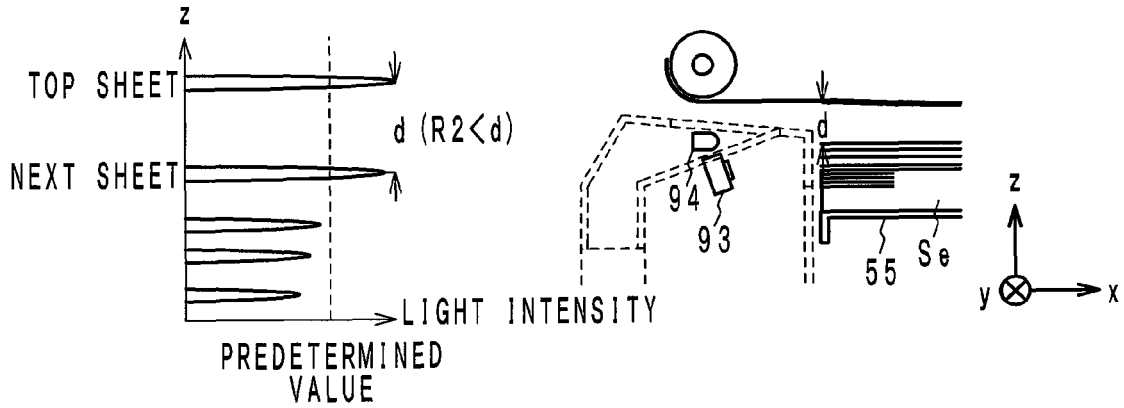
FIG. 9C is a diagram illustrating a calculated gap above an upper limit of the appropriate range.

The control circuit 15 performs feedback control of the rotation of the drive motors M4 and M5 on the basis of the calculated gap, thereby adjusting the amount of air blown out from each of the first blowing mechanisms 67 and/or the amount of air blown out from the second blowing mechanism 69. More specifically, when the sheet gap d is within a predetermined range between a lower limit R1 and an upper limit R2, as shown in FIG. 9A, the amount of air is left unchanged. On the other hand, when the sheet gap d is below the lower limit R1, as shown in FIG. 9B, the amount of air is adjusted to be lower. In addition, when the sheet gap d is above the upper limit R2, as shown in FIG. 9C, the amount of air is adjusted to be higher.

Actions and Effects

As described above, the sheet feeding device 53 includes the illuminating device 94. The illuminating device 94 is disposed such that light emitted therefrom illuminates the foremost edges of the top sheet and the next sheet in a direction substantially normal thereto. Moreover, the illuminating device 94 and the image pickup device 93 are close to each other in terms of their positions in the z-axis direction. Therefore, the intensity of light reflected by the foremost edges of the sheets is high in an intensity image obtained from a captured image (see FIG. 8). Thus, the control circuit 15 can detect the edge of each sheet with accuracy by the simple process of comparing the intensity of reflected light to a reference value. In this manner, edge detection can be performed with accuracy, and therefore, a precise value can be obtained for the gap between sheets.

Furthermore, in the sheet feeding device 53, the foremost edge of the top sheet is attracted to the suction belts 74 so as not to hang downward. Moreover, the image pickup device 93 is positioned so as to essentially face an area where the foremost edge of the top sheet crosses the suction belts 74 (i.e., space γ as mentioned earlier), so that the area can be seen through. Accordingly, the foremost edge of the top sheet can be prevented from overlapping with the next sheet in image data obtained by the image pickup device 93. By using such image data, the control circuit 15 can calculate the gap between the sheets more accurately.

Configuration Examples of Illuminating Device

Figure 10A:
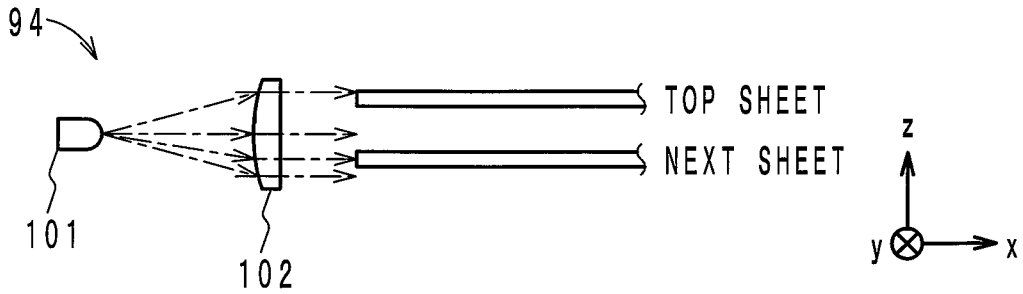
FIG. 10A is a diagram illustrating a first configuration example where parallel light from an illuminating device illuminates foremost edges of sheets.
Figure 10B:
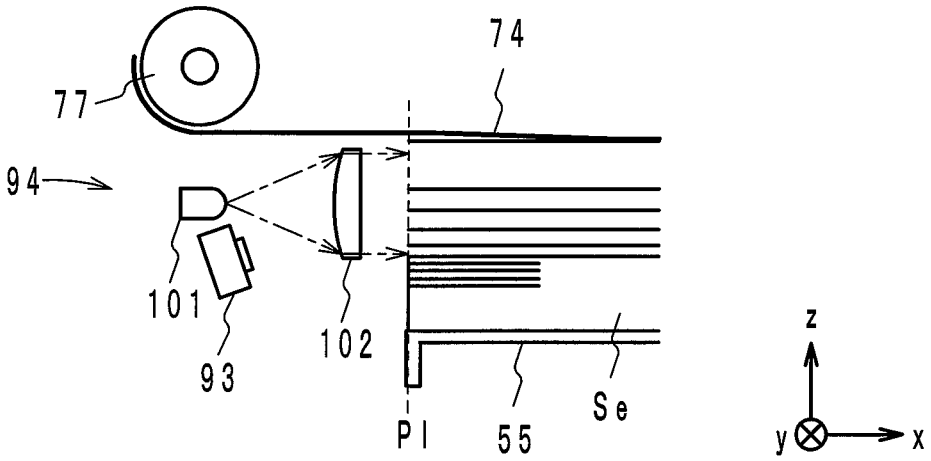
FIG. 10B is a schematic diagram illustrating the configuration and arrangement of the illuminating device in the first configuration example.

As is apparent from the foregoing, light emitted by the illuminating device 94 illuminates the foremost edges of the top sheet and the next sheet, which are different in their positions in the z-axis direction, preferably in a direction approximately normal thereto. In an example of such a configuration, the illuminating device 94 includes a light source 101 and a convex lens 102, as shown in FIGS. 10A and 10B. The light source 101 is disposed at the focal position of the convex lens 102, and emits radiant light. The convex lens 102 converts the light emitted by the light source 101 into parallel light. This parallel light illuminates plane P1.

Figure 11A:
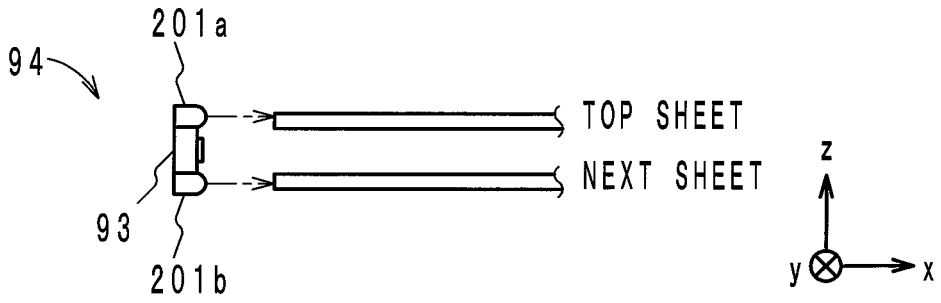
FIG. 11A is a diagram illustrating a second configuration example where parallel light from an illuminating device illuminates foremost edges of sheets.
Figure 11B:
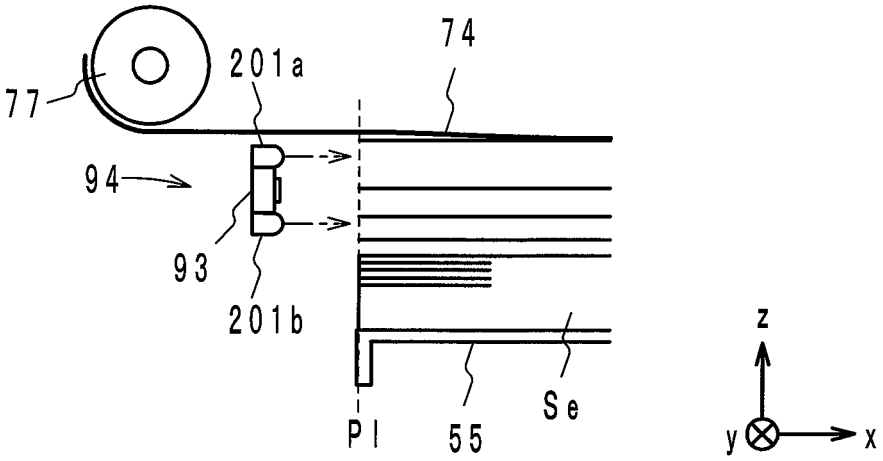
FIG. 11B is a schematic diagram illustrating the configuration and arrangement of the illuminating device in the second configuration example.

In a second configuration example, the illuminating device 94 includes at least two light sources 201*a* and 201*b*, as shown in FIGS. 11A and 11B. The light sources 201*a* and 201*b* are disposed respectively above and below the image pickup device 93. In other words, the light sources 201*a* and 201*b* are arranged so as to be different in their positions in the z-axis direction. Here, the light sources 201*a* and 201*b* are disposed with their optical axes approximately perpendicular to plane P1 and parallel to the optical axis of the image pickup device 93. In addition, there are no optical elements, such as a lens and a mirror, provided between plane P1 and the light sources 201*a* and 201*b*.

Figure 12A:
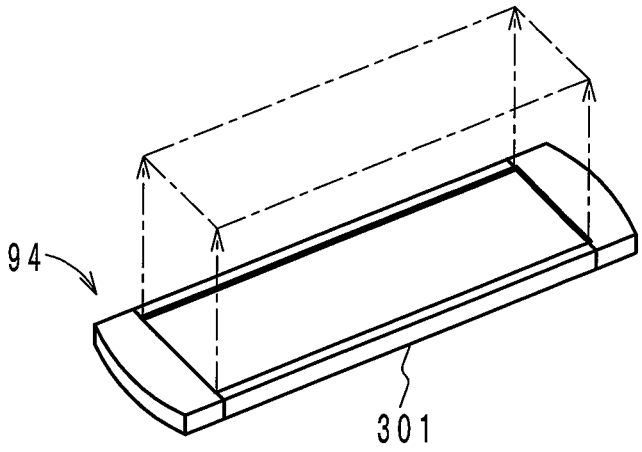
FIG. 12A is an oblique view of an illuminating device in a third configuration example.
Figure 12B:
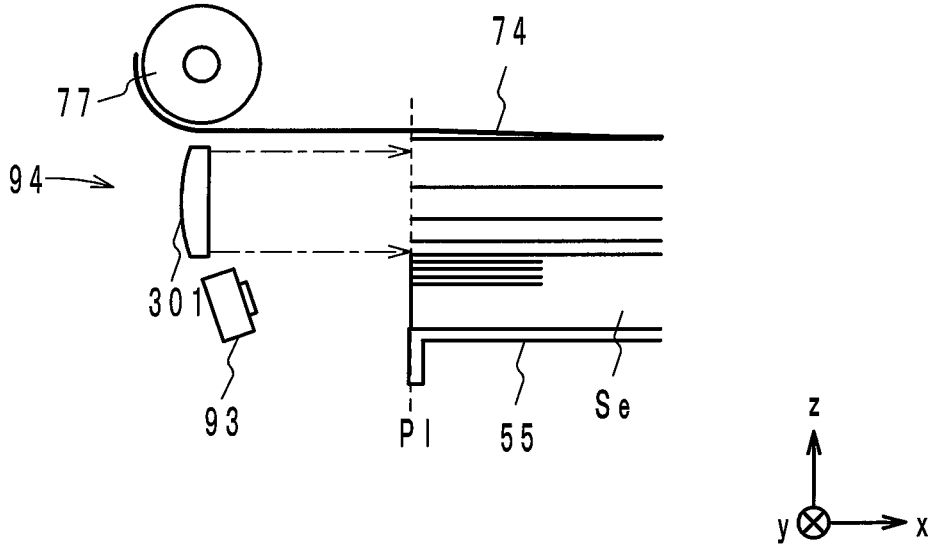
FIG. 12B is a schematic diagram illustrating the configuration and arrangement of the illuminating device in the third configuration example.

In a third configuration example, the illuminating device 94 includes a surface-emitting light 301, as shown in FIGS. 12A and 12B. The surface-emitting light 301 emits a bundle of beams from different positions in the z-axis direction, and is disposed such that the beams illuminate plane P1 in a direction approximately normal thereto. Note that there are no optical elements provided between the surface-emitting light 301 and plane P1.

Figure 13A:
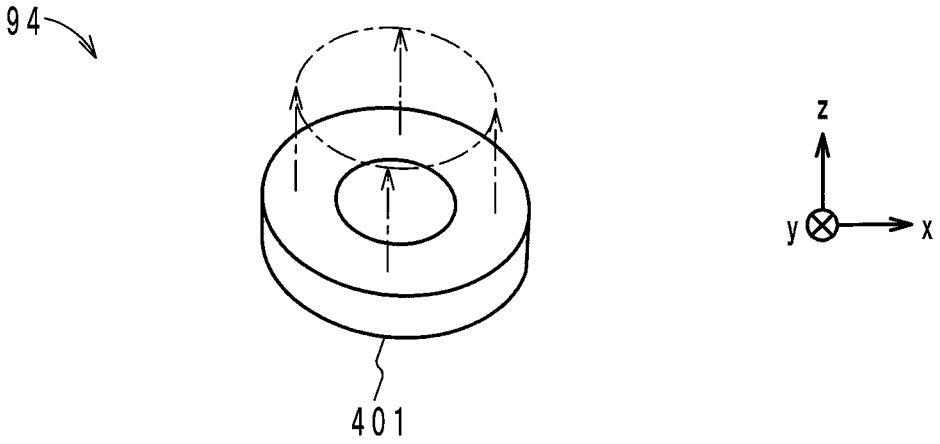
FIG. 13A is an oblique view of an illuminating device in a fourth configuration example.
Figure 13B:
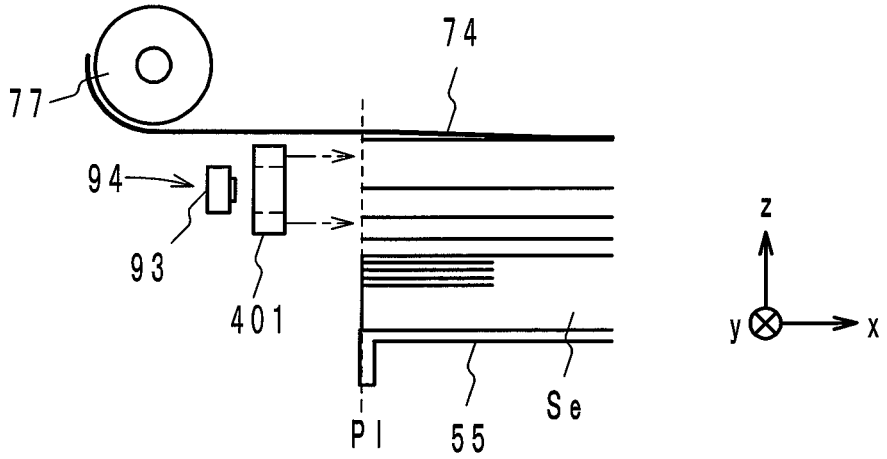
FIG. 13B is a schematic diagram illustrating the configuration and arrangement of the illuminating device in the fourth configuration example.

In a fourth configuration example, the illuminating device 94 includes a ring light 401 consisting of a plurality of light sources arranged in a ring, as shown in FIGS. 13A and 13B. The ring light 401 is disposed between the image pickup device 93 and plane P1. More specifically, the light sources are disposed with their optical axes approximately perpendicular to plane P1 and parallel to the optical axis of the image pickup device 93. In this case, the image pickup device 93 is disposed such that the top sheet and the next sheet, which are to be captured in an image, can be seen through the hole in the center of the ring light 401. The illuminating device 94 thus configured emits a bundle of beams from different positions in the z-axis direction, and is disposed such that the beams illuminate plane P1 in a direction approximately normal to plane P1.

Figure 14A:
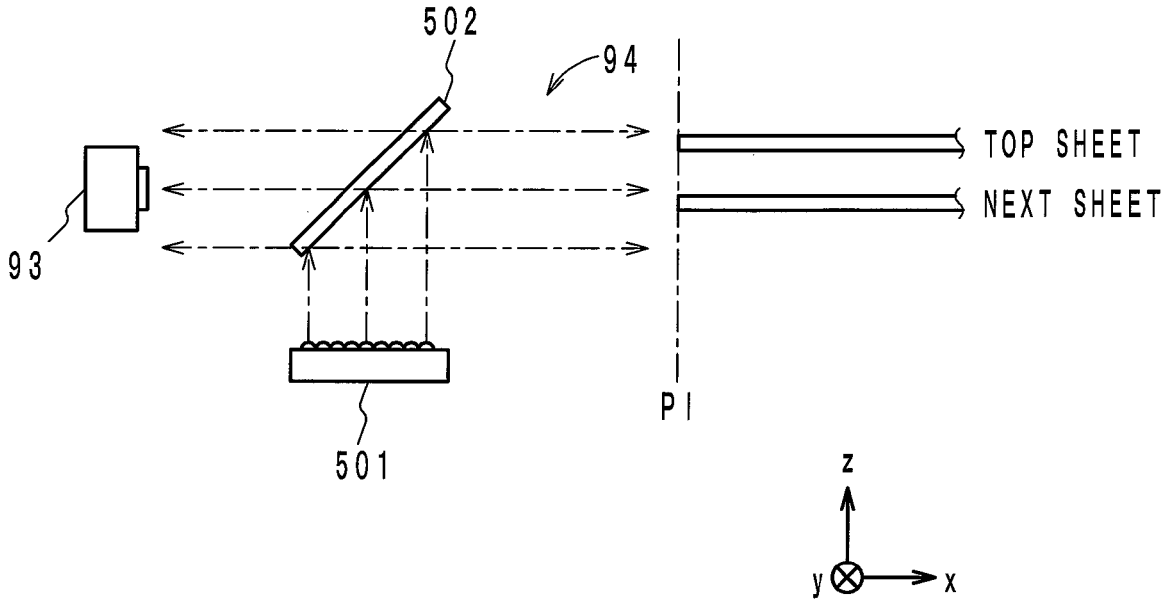
FIG. 14A is a diagram illustrating in detail the configuration of an illuminating device in a fifth configuration example.
Figure 14B:
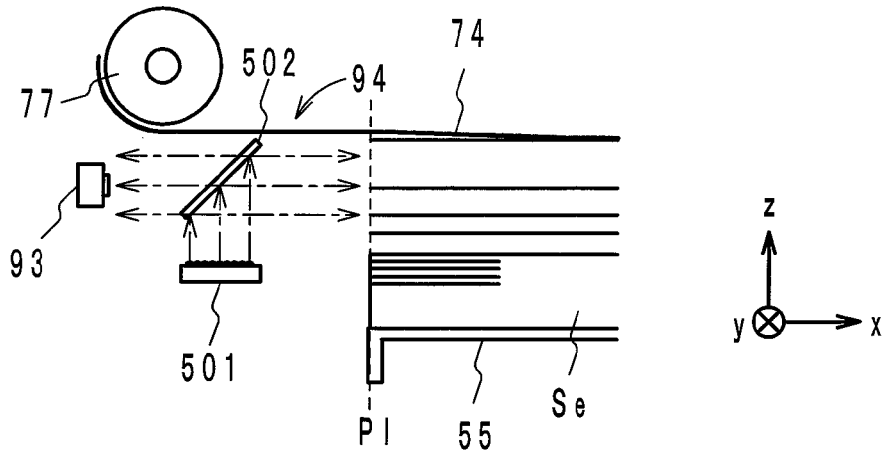
FIG. 14B is a schematic diagram illustrating the arrangement of the illuminating device in the fifth configuration example.

In a fifth configuration example, the illuminating device 94 employs coaxial lighting, as shown in FIGS. 14A and 14B. In the case where coaxial lighting is employed, the image pickup device 93 is disposed so as to be able to capture an image of the top sheet and the next sheet, with its optical axis approximately perpendicular to plane P1. The illuminating device 94 includes a light source 501 and a half-silvered mirror 502. The light source 501 is, for example, a surface-emitting light that emits a bundle of beams approximately normal to the optical axis of the image pickup device 93. The half-silvered mirror 502 is disposed between the image pickup device 93 and plane P1, such that its reflective surface is tilted 45 degrees relative to the optical axis of the image pickup device 93. In addition, the reflective surface of the half-silvered mirror 502 is also tilted 45 degrees relative to the direction in which the light source 501 emits the bundle of beams.

With this configuration, the bundle of beams from the light source 501 is reflected by the half-silvered mirror 502 so as to illuminate the foremost edges of the top sheet and the next sheet in a direction approximately normal thereto. Light reflected by the foremost edges is transmitted through the half-silvered mirror 502 and enters the image pickup device 93 as regular reflection light. The image pickup device 93 uses such regular reflection light to capture an image of the foremost edges of the top sheet and the next sheet. Thus, the control circuit 15 can detect edges with high precision.

Note that in the fifth configuration example, the light source 501 may be a point source of light, rather than a surface-emitting light.

Although the present invention has been described in connection with the preferred embodiment above, it is to be noted that various changes and modifications are possible to those who are skilled in the art. Such changes and modifications are to be understood as being within the scope of the invention.

What is claimed is:

1. A sheet feeding device comprising:

a mounting portion capable of accommodating a stack of sheets placed in a predetermined direction;

a blowing device configured to blow air onto the stack of sheets placed in the mounting portion, thereby floating at least a top sheet from the stack of sheets;

a suction/transportation mechanism including a suction belt provided above the mounting portion, the suction/transportation mechanism being configured to attract the top sheet floated by the blowing device to transport the attracted sheet toward a transportation path;

an illuminating device configured to emit light toward an area to be captured by an image pickup device in a plane formed by an end surface of the stack of sheets which is closest to the image pickup device, the illuminating device being disposed so as to emit the light in a direction substantially normal to the plane at a position of the floated top sheet;

the image pickup device disposed so as to be capable of capturing an image of light reflected by an edge of the floated top sheet and an edge of a next sheet therebelow; and a controller configured to:

obtain a gap distance value between the floated top sheet and the next sheet based on the image captured by the image pickup device; and adjust an amount of the air blown by the blowing device based on the obtained gap distance value.

2. The sheet feeding device according to claim 1, wherein the illuminating device and the image pickup device are provided close to each other with respect to their positions in the predetermined direction.

3. The sheet feeding device according to claim 1, further comprising a lens configured to convert the light emitted by the illuminating device into parallel light substantially normal to the plane.

4. The sheet feeding device according to claim 1, wherein the illuminating device includes a plurality of light sources arranged at different positions in the predetermined direction, each light source emitting light substantially normal to the plane.

5. The sheet feeding device according to claim 1, wherein the illuminating device comprises a surface-emitting light that emits the light to illuminate the plane in the direction substantially normal thereto.

6. The sheet feeding device according to claim 1, wherein the illuminating device includes:

a surface-emitting light; and a half-silvered mirror configured to make the light emitted by the surface-emitting light parallel to an optical axis of the image pickup device so as to be directed to the area to be captured by the image pickup device.

7. The sheet feeding device according to claim 1, wherein the illuminating device is provided on the transportation path side relative to the stack of sheets when viewed in a plan view in the predetermined direction.

8. The sheet feeding device according to claim 1, wherein when the obtained gap distance value is within a predetermined range, the controller is configured to maintain the amount of the air blown by the blowing device.

9. The sheet feeding device according to claim 1, wherein when the obtained gap distance value is less than a lower limit of a predetermined range, the controller is configured to decrease the amount of the air blown by the blowing device.

10. The sheet feeding device according to claim 1, wherein when the obtained gap distance value is greater than an upper limit of a predetermined range, the controller is configured to increase the amount of the air blown by the blowing device.

11. The sheet feeding device according to claim 1, wherein the image pickup device is disposed so as to perform imaging through an area where a side of the top sheet and the suction belt, when viewed in a plan view in the predetermined direction, are close to each other during the floating of the top sheet to such an extent that the side of the top sheet substantially does not hang downward.

12. An image forming apparatus comprising the sheet feeding device of claim 1.

13. The sheet feeding device according to claim 1, wherein the end surface of the stack of sheets comprises leading edges of the sheets in the stack with respect to a sheet transportation direction.

14. The sheet feeding device according to claim 1, wherein the illuminating device is provided at a height between the top sheet before being floated and the suction belt.

* * * * *